US011422499B2

(12) United States Patent
Kitagawa

(10) Patent No.: US 11,422,499 B2
(45) Date of Patent: Aug. 23, 2022

(54) IMAGE FORMING APPARATUS

(71) Applicant: KYOCERA Document Solutions Inc., Osaka (JP)

(72) Inventor: Hiroaki Kitagawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/198,994

(22) Filed: Mar. 11, 2021

(65) Prior Publication Data

US 2021/0286315 A1 Sep. 16, 2021

(30) Foreign Application Priority Data

Mar. 12, 2020 (JP) ..... JP2020-042665

(51) Int. Cl.
*G03G 15/04* (2006.01)
*G03G 21/16* (2006.01)
*G03G 21/18* (2006.01)

(52) U.S. Cl.
CPC ..... *G03G 21/1676* (2013.01); *G03G 21/1652* (2013.01); *G03G 21/1842* (2013.01)

(58) Field of Classification Search
CPC ..... G03G 21/1652; G03G 21/1676; G03G 21/1842
USPC ..... 399/107, 110, 111, 119
See application file for complete search history.

(56) References Cited

U.S. PATENT DOCUMENTS 10,025,264 B1 * 7/2018 Itabashi ..... G03G 21/1652

FOREIGN PATENT DOCUMENTS

JP 2010113143 A 5/2010

* cited by examiner

*Primary Examiner* — Hoan H Tran
(74) *Attorney, Agent, or Firm* — Alleman Hall Creasman & Tuttle LLP

(57) ABSTRACT

A first connector is provided in a main body portion. A connector support mechanism is provided in an attachment unit and supports a second connector so that the second connector can be displaced along a second direction that intersects a first direction. A unit guide portion guides the attachment unit between a connection position and a position that is more separated from a main body portion than the connection position is, along the first direction, and further guides the attachment unit between the connection position and an attachment position. The connection position is a position at which the attachment unit is located when the second connector is connected to the first connector. The connector support mechanism allows the attachment unit to move between the connection position and the attachment position.

4 Claims, 6 Drawing Sheets

IMAGE FORMING APPARATUS

INCORPORATION BY REFERENCE

This application is based upon and claims the benefit of priority from the corresponding Japanese Patent Application No. 2020-042665 filed on Mar. 12, 2020, the entire contents of which are incorporated herein by reference.

BACKGROUND

The present disclosure relates to an image forming apparatus including an attachment unit that is attached to a main body portion in a detachable manner.

An electrophotographic image forming apparatus includes a print device that generates a toner image and forms the toner image on a sheet. The print device includes a photoconductor, a charging device, a laser scanning unit, a developing device, a cleaning device, a transfer device, and a fixing device.

There is known a configuration where a part of the print device is provided as a unit that is attached to a main body portion in a detachable manner. For example, there is known a configuration where the photoconductor, the charging device, the developing device, and the cleaning device are integrated as a process unit that is attached to the main body portion in a detachable manner.

SUMMARY

An image forming apparatus according to an aspect of the present disclosure includes an attachment unit, a first connector, a second connector, a connector support mechanism, and a unit guide portion. The attachment unit is attached to a main body portion in a detachable manner, the main body portion including a print device configured to form an image on a sheet, the attachment unit including a facing part disposed to face a target part that constitutes a part of the print device in the main body portion, the facing part constituting another part of the print device. The first connector is provided in the main body portion. The second connector is configured to be connected to the first connector by being made to approach the first connector along a first direction. The connector support mechanism is provided in the attachment unit, the connector support mechanism supporting the second connector so that the second connector can be displaced along a second direction that intersects the first direction, and temporarily holding the second connector at a predetermined reference position in the second direction. The unit guide portion is provided in the main body portion and configured to guide the attachment unit between a connection position and a position that is more separated from the main body portion than the connection position is, along the first direction in a slidably moving manner, the connection position being a position at which the attachment unit is located when the second connector held at the reference position is connected to the first connector, the unit guide portion further guiding the attachment unit between the connection position and an attachment position that is closer to the target part than the connection position is, along the second direction in the slidably moving manner. The connector support mechanism allows the attachment unit to move between the connection position and the attachment position in a state where the second connector is connected to the first connector.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings. It should be noted that the following embodiment is an example of a specific embodiment of the present disclosure and should not limit the technical scope of the present disclosure.

[Configuration of Image Forming Apparatus 10]

An image forming apparatus 10 according to an embodiment executes a print process to form an image on a sheet 9 by an electrophotographic method. For example, the image forming apparatus 10 is a printer, a copier, a facsimile apparatus, or a multifunction peripheral.

Figure 1:
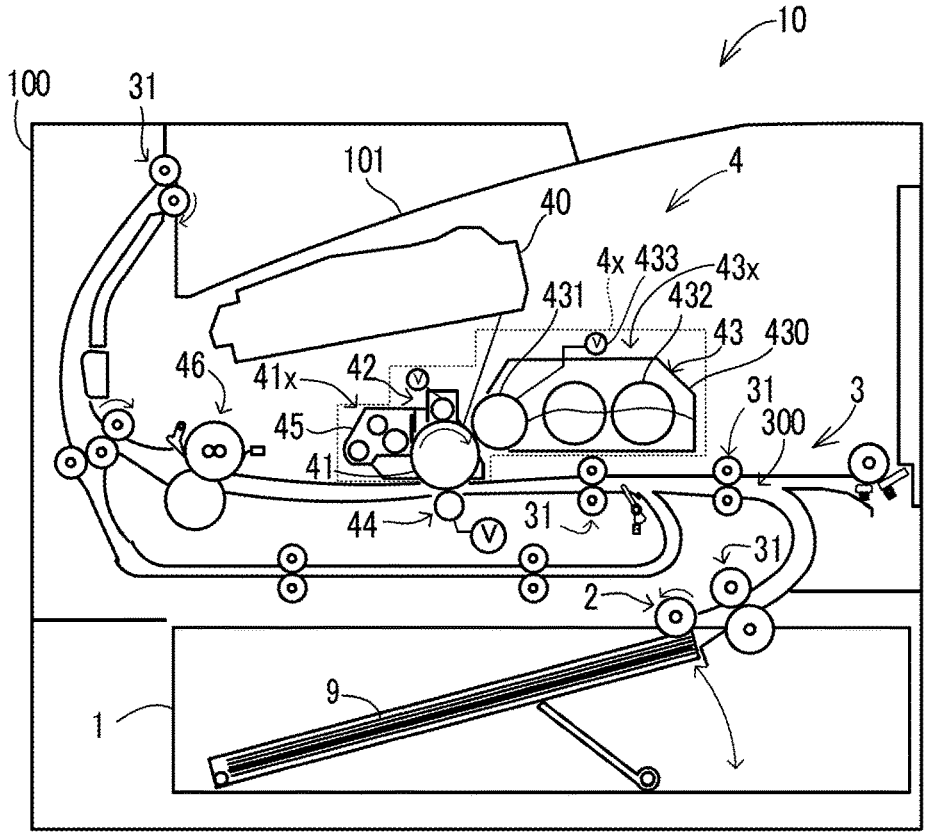
FIG. 1 is a configuration diagram of an image forming apparatus according to an embodiment.

As shown in FIG. 1, the image forming apparatus 10 includes a sheet storage portion 1, a sheet feed device 2, a sheet conveying device 3, and a print device 4. The print device 4 executes the print process. The sheet conveying device 3 and the print device 4 are provided in a main body portion 100.

The sheet feed device 2 is configured to feed sheets 9 stored in the sheet storage portion 1, one by one into a conveyance path 300 in the main body portion 100. The conveyance path 300 is a sheet conveyance path in which the sheet 9 are conveyed.

In the sheet conveying device 3, a plurality of pairs of conveyance rollers 31 convey the sheet 9 that has been fed into the conveyance path 300 by the sheet feed device 2, along the conveyance path 300, and discharge the sheet 9 onto a sheet discharge tray 101.

The print device 4 is configured to form a toner image on the sheet 9 that is conveyed along the conveyance path 300. The print device 4 includes a laser scanning unit 40, a photoconductor 41, a charging device 42, a developing device 43, a transfer device 44, a cleaning device 45, and a fixing device 46.

The drum-like photoconductor 41 rotates, and the charging device 42 electrically charges the outer peripheral surface of the photoconductor 41. The laser scanning unit 40 scans a laser beam on the electrically charged outer peripheral surface of the photoconductor 41. With this operation, an electrostatic latent image is formed on the surface of the photoconductor 41.

The developing device 43 develops the electrostatic latent image as a toner image by supplying toner to the outer peripheral surface of the photoconductor 41 on which the electrostatic latent image has been formed. The developing device 43 includes a developer tank 430 and a developing roller 431, wherein the developer tank 430 stores toner, and the developing roller 431 supplies the toner to the surface of the photoconductor 41.

The developing device 43 further includes a conveyance screw 432 and a developing bias application portion 433. The conveyance screw 432 stirs the toner by circulating it in the developer tank 430. The developing bias application portion 433 applies a bias voltage to the developing roller 431. The developing roller 431 and the conveyance screw 432 are rotationally driven by a drive device (not shown).

The transfer device 44 transfers the toner image from the photoconductor 41 to the sheet 9. The cleaning device 45 removes the toner that has remained on the photoconductor 41 after the transfer of the toner image. The fixing device 46 applies heat and pressure to the toner image transferred to the sheet 9. This allows the toner image to be fixed to the sheet 9.

In the following description, the photoconductor 41 and devices arranged around the photoconductor 41 to process the toner image are referred to as a image creating portion 4*x*. In the present embodiment, the image creating portion 4*x* includes the photoconductor 41, the charging device 42, the developing device 43, and the cleaning device 45.

Figure 2:
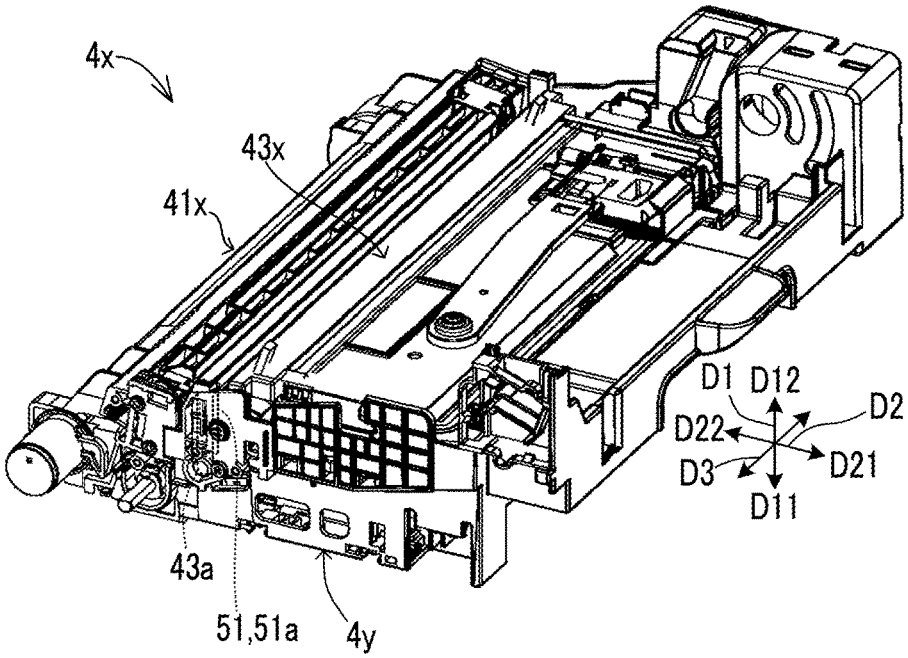
FIG. 2 is a perspective diagram of an image creating portion of the image forming apparatus according to the embodiment.
Figure 3:
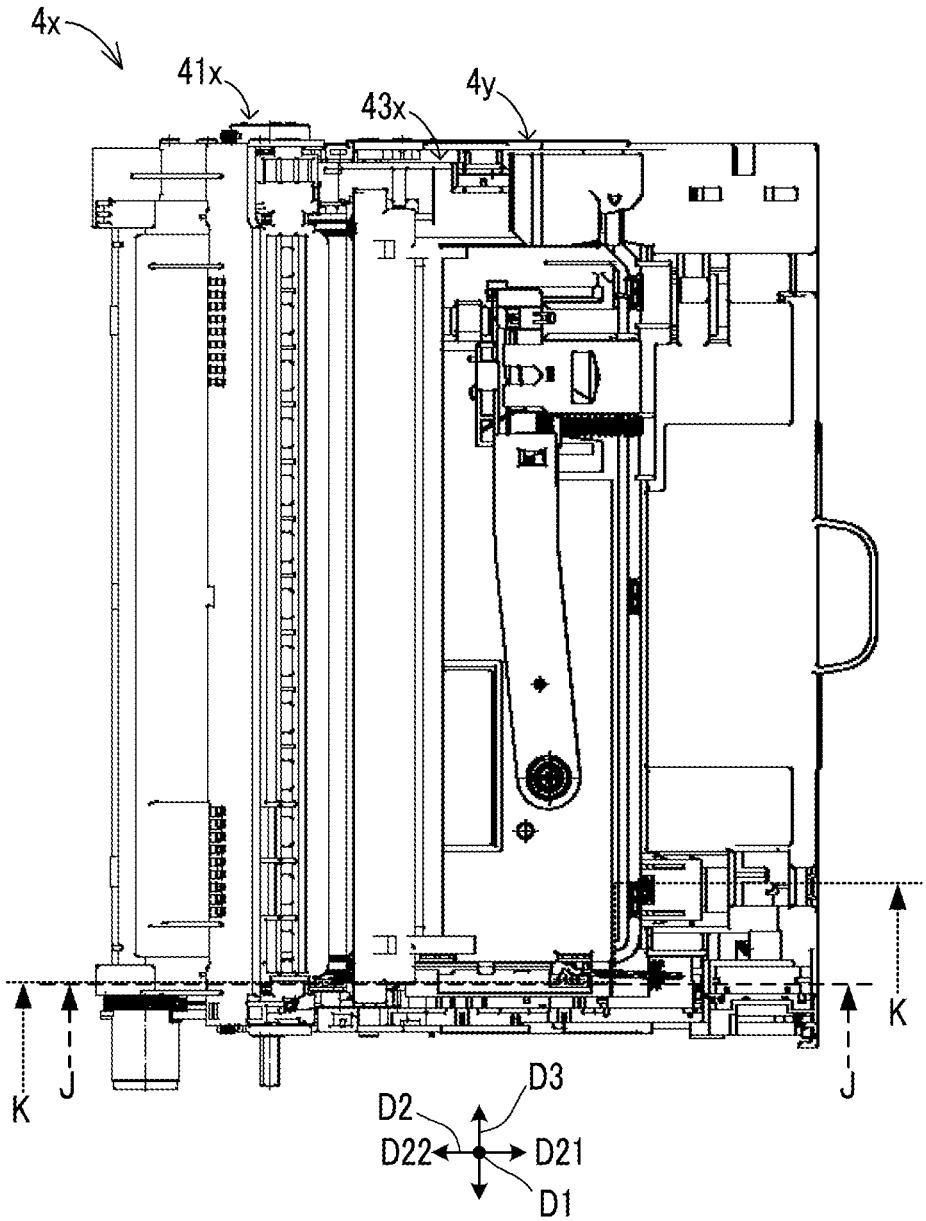
FIG. 3 is a plan diagram of the image creating portion of the image forming apparatus according to the embodiment.

FIG. 2 is a perspective diagram of the image creating portion 4*x*, and FIG. 3 is a plan diagram of the image creating portion 4*x*. In FIG. 4, FIG. 5, and FIG. 8 to FIG. 10, the figures labelled as "J-J" are cross sections taken along a J-J line shown in FIG. 3, and the figures labelled as "K-K" are cross sections taken along a K-K line shown in FIG. 3.

Meanwhile, there may be a case where a developing unit 43*x* that includes the developing device 43 is attached, in a detachable manner, to the main body portion 100 in which the photoconductor 41 is provided. In the present embodiment, too, the developing device 43 is unitized as the developing unit 43*x*, and the developing unit 43*x* is attached, in a detachable manner, to the main body portion 100.

The developing roller 431 included in the developing device 43 is disposed in a state where it is in contact with the photoconductor 41 or there is only a small gap between itself and the photoconductor 41. The photoconductor 41 is an example of an image carrier.

If the developing roller 431 makes a strong contact with the photoconductor 41 when the developing unit 43*x* is attached, the photoconductor 41 may be damaged. As a result, the developing unit 43*x* needs to be attached with great care.

In the present embodiment, the photoconductor 41 is an example of a target part that constitutes a part of the print device 4 in the main body portion 100. In addition, the developing roller 431 is an example of a facing part that constitutes another part of the print device 4. In addition, the developing unit 43*x* is an example of an attachment unit that includes a part of the print device 4.

On the other hand, there is a need for a system in which even a general user can replace the attachment unit such as the developing unit 43*x*. To satisfy the need, it is desired that the components such as the photoconductor 41 are difficult to be damaged when the attachment unit is attached to or detached from the main body portion 100.

In addition, the developing unit 43*x* includes electronic parts such as the developing bias application portion 433. Accordingly, it is necessary to connect a connector to connect a transmission line or a signal line between the developing unit 43*x* and the main body portion 100, when the developing unit 43*x* is attached to the main body portion 100.

However, it is not preferable for the general user to perform the attachment/detachment of the attachment unit that includes a work of connecting the connector since the attachment/detachment of the attachment unit requires a complicated operation and it is difficult to ensure safety therefor.

The image forming apparatus 10 has a configuration that provides simple attachment/detachment of the developing unit 43*x* to/from the main body portion 100 and prevents the photoconductor 41 from being damaged when the developing unit 43*x* is attached/detached. The following describes the configuration.

In FIG. 2 to FIG. 10, a downward direction D11, an upward direction D12, a frontward direction D21, and a backward direction D22 are indicated by the arrows. Furthermore, a first direction D1, a second direction D2, and a third direction D3 are indicated by the arrows. In the present embodiment, the first direction D1 is an up-down direction, the second direction D2 is a front-back direction, and the third direction D3 is a width direction.

Figure 4:
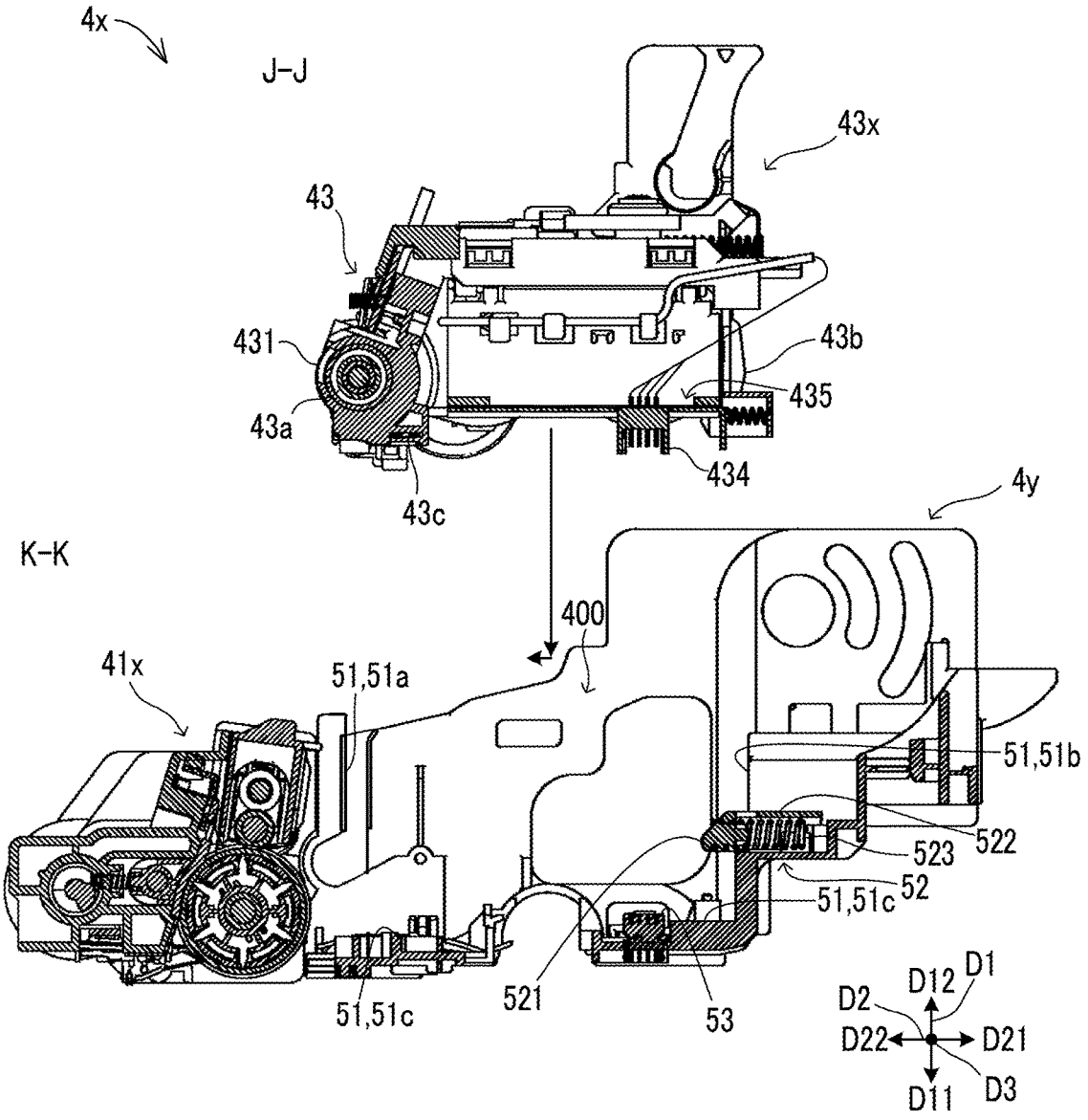
FIG. 4 is a partially exploded cross-section diagram of the image creating portion of the image forming apparatus according to the embodiment.

As shown in FIG. 4, the image creating portion 4*x* includes an image creation base portion 4*y* and the developing unit 43*x*, wherein the image creation base portion 4*y* constitutes a part of the main body portion 100, and the developing unit 43*x* is attached to the image creation base portion 4*y* in a detachable manner. The image creation base portion 4*y* includes a drum unit 41*x*, a unit guide portion 51, and a main body connector 53. The main body connector 53 is an example of a first connector.

In addition, a unit connector 434 and a connector support mechanism 435 are provided in the developing unit 43*x*. The unit connector 434 is connected to the main body connector 53 by being made to approach the main body connector 53 from above along the first direction D1. The unit connector 434 is an example of a second connector.

The unit connector 434 is electrically connected to electronic parts, such as the developing bias application portion 433, included in the developing unit 43*x*. In addition, the main body connector 53 is electrically connected to either one or both of a transmission circuit and a signal input device, wherein the transmission circuit supplies power to the electronic parts included in the developing unit 43*x*, and the signal input device inputs a signal output from the electronic parts.

When the unit connector 434 is connected to the main body connector 53, the electronic parts included in the developing unit 43*x* are electrically connected to either one or both of the transmission circuit and the signal input device of the main body portion 100.

The connector support mechanism 435 is provided in the developing unit 43*x* and supports the unit connector 434 so that the unit connector 434 can be displaced along the second direction D2. The second direction D2 is an example of a direction intersecting the first direction D1. In the present embodiment, the second direction D2 is perpendicular to the first direction D1.

Figure 6:
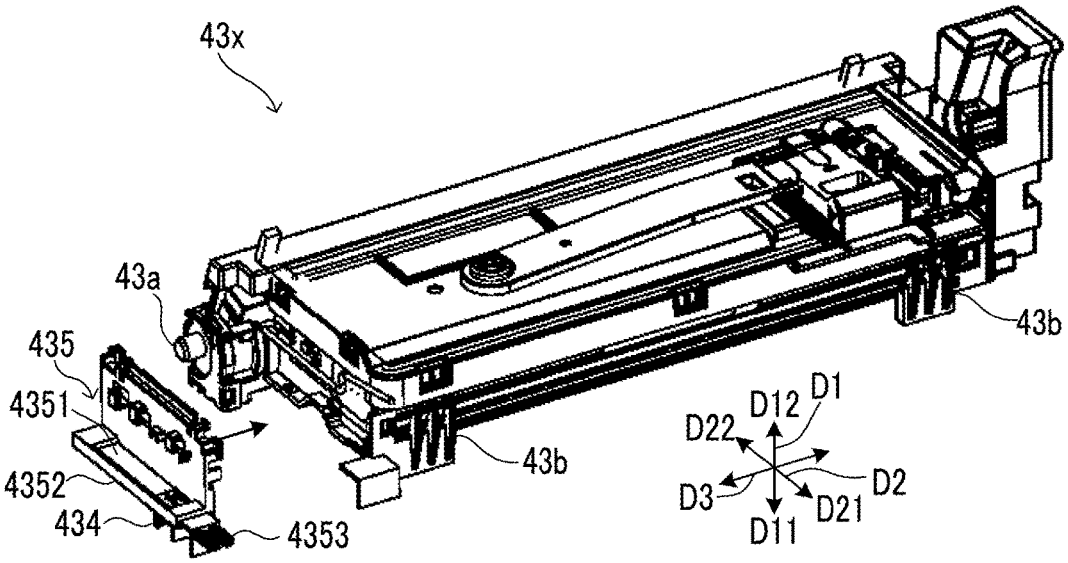
FIG. 6 is a partially exploded perspective diagram of a developing unit of the image forming apparatus according to the embodiment.

Furthermore, the connector support mechanism 435 temporarily holds the unit connector 434 at a predetermined reference position in the second direction D2. FIG. 6 shows a state before the connector support mechanism 435 that supports the unit connector 434, is attached to the developing unit 43*x*.

Figure 7:
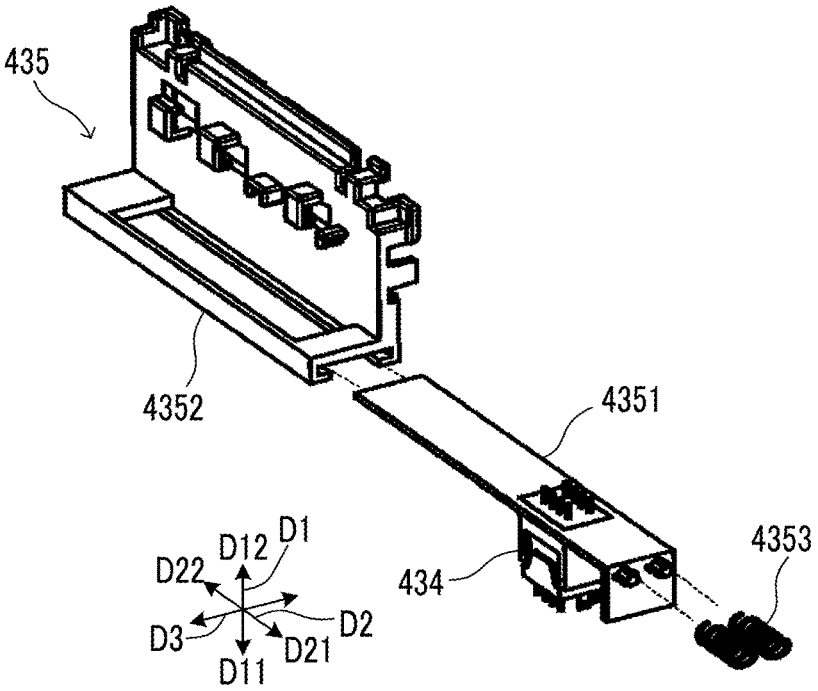
FIG. 7 is an exploded perspective diagram of a connector support mechanism of the image forming apparatus according to the embodiment.

As shown in FIG. 7, the connector support mechanism 435 includes a connector support member 4351, a slide support portion 4352, and a spring 4353.

The connector support member 4351 supports the unit connector 434. The slide support portion 4352 supports the connector support member 4351 so that the connector support member 4351 can be slidably displaced along the second direction D2.

The spring 4353 temporarily holds the unit connector 434 at the reference position by elastically biasing the unit connector 434 toward the reference position via the connector support member 4351. The spring 4353 is an example of an elastic member.

In the present embodiment, the reference position is at an end of a movable range of the unit connector 434 in the backward direction D22. The spring 4353 temporarily holds the unit connector 434 at the reference position by elastically biasing the connector support member 4351 in the backward direction D22.

It is noted that the connector support mechanism 435 may include a locking mechanism in place of the spring 4353, wherein the locking mechanism locks the connector support member 4351 in the second direction D2. The locking mechanism temporarily holds the unit connector 434 at the reference position by locking the connector support member 4351.

The locking of the connector support member 4351 by the locking mechanism is released when an external force in the frontward direction D21 exceeding a predetermined force is applied to the connector support member 4351. For example, the locking mechanism includes a flexible locking portion that locks the connector support member 4351. The flexible locking portion releases the locking of the connector support member 4351 when an external force exceeding a certain force is applied thereto.

The unit guide portion 51 is provided in the image creation base portion 4*y* and includes first unit guide portions 51*a* and 51*b* and a second guide portion 51*c*. The first unit guide portions 51*a* and 51*b* include a pair of side unit guide portions 51*a* and a front unit guide portion 51*b*. The pair of side unit guide portions 51*a* are provided at opposite sides of a unit storage space 400 in the third direction D3 in the image creation base portion 4*y*, wherein the developing unit 43*x* is disposed in the unit storage space 400. The front unit guide portion 51*b* is provided in back of the unit storage space 400 in the frontward direction D21 in the image creation base portion 4*y*. The second unit guide portion 51*c* is provided below the unit storage space 400 in the downward direction D11 in the image creation base portion 4*y*.

On the other hand, the developing unit 43*x* includes a pair of side guided portions 43*a* and a front guided portion 43*b*, wherein the pair of side guided portions 43*a* are guided along the first direction D1 by the pair of side unit guide portions 51*a*, and the front guided portion 43*b* is guided along the first direction D1 by the front unit guide portion 51*b* (see FIG. 4). The developing unit 43*x* further includes a second guided portion 43*c* that is guided along the second direction D2 by the second unit guide portion 51*c* (see FIG. 4, FIG. 5).

The first guide portions 51*a* and 51*b* guide the developing unit 43*x* between a predetermined connection position and a position that is more separated from the image creation base portion 4*y* than the connection position is, along the first direction D1 in a slidably moving manner, while restricting the movement of the developing unit 43*x* in the second direction D2 and the third direction D3. The connection position is a position at which the developing unit 43*x* is located when the unit connector 434 held at the reference position is connected to the main body connector 53.

Specifically, the pair of side unit guide portions 51*a* respectively form grooves that extend along the first direction D1. The pair of side guided portions 43*a* are formed to project outside the developing roller 431 in opposite directions along the third direction D3 on an extended line of a rotation shaft of the developing roller 431. When the developing unit 43*x* approaches to or separates from the connection position along the first direction D1, the top and side surfaces, in the second direction D2, of each of the pair of side guided portions 43*a* slide against the bottom surface and opposite side surfaces of each of the grooves formed by the pair of side unit guide portions 51*a*. This allows the pair of side unit guide portions 51*a* to guide the pair of side guided portions 43*a* along the first direction D1, while restricting the movement of the pair of side guided portions 43*a* in the second direction D2 and the third direction D3.

In addition, the front unit guide portion 51*b* forms a plane extending along the first direction D1. The front guided portion 43*b* is a plurality of ribs that are formed to project in the frontward direction D21 and extend along the first direction D1 (see FIG. 6). When the developing unit 43*x* approaches to or separates from the connection position along the first direction D1, the top of the front guided portion 43*b* slides against the front unit guide portion 51*b*. This allows the front unit guide portion 51*b* to guide the front guided portion 43*b* along the first direction D1, while restricting the movement of the front guided portion 43*b* in the second direction D2. As a result, the developing unit 43*x* is guided along the first direction D1.

When the developing unit 43*x* is guided to the connection position by the first unit guide portions 51*a* and 51*b*, the unit connector 434 approaches the main body connector 53 along the first direction D1 and is connected to the main body connector 53. The unit connector 434 and the main body connector 53 are what is called drawer connectors.

The second unit guide portion 51*c* guides the developing unit 43*x* between the connection position and an attachment position that is closer to the photoconductor 41 than the connection position is, along the second direction D2 in a slidably moving manner, while restricting the movement of the developing unit 43*x* in the downward direction D11.

Specifically, the second guided portion 43*c* constitutes a part of the bottom surface of the developing unit 43*x*, and the second unit guide portion 51*c* forms a plane extending in the second direction D2. The second unit guide portion 51*c* restricts the movement of the developing unit 43$x$ in the downward direction D11 by abutting on the second guided portion 43$c$.

When the developing unit 43$x$ moves between the attachment position and the connection position along the second direction D2, the second guided portion 43$c$ slides against the second unit guide portion 51$c$. This allows the second unit guide portion 51$c$ to guide the second guided portion 43$c$ along the second direction D2 while restricting the movement of the second guided portion 43$c$ in the downward direction D11. As a result, the developing unit 43$x$ is guided along the second direction D2.

When the attachment of the developing unit 43$x$ is completed, the developing unit 43$x$ is located at the attachment position. In the present embodiment, the attachment position is in back of the connection position.

Figure 5:
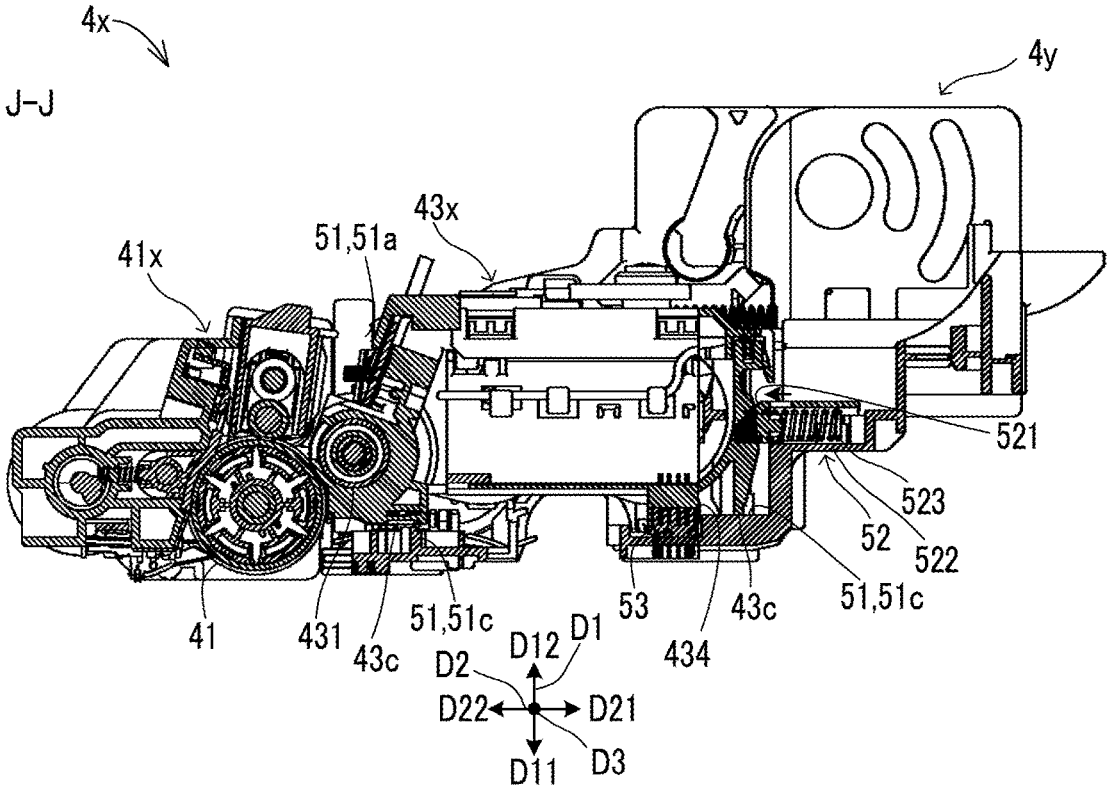
FIG. 5 is a first cross-section diagram of the image creating portion of the image forming apparatus according to the embodiment.
Figure 8:
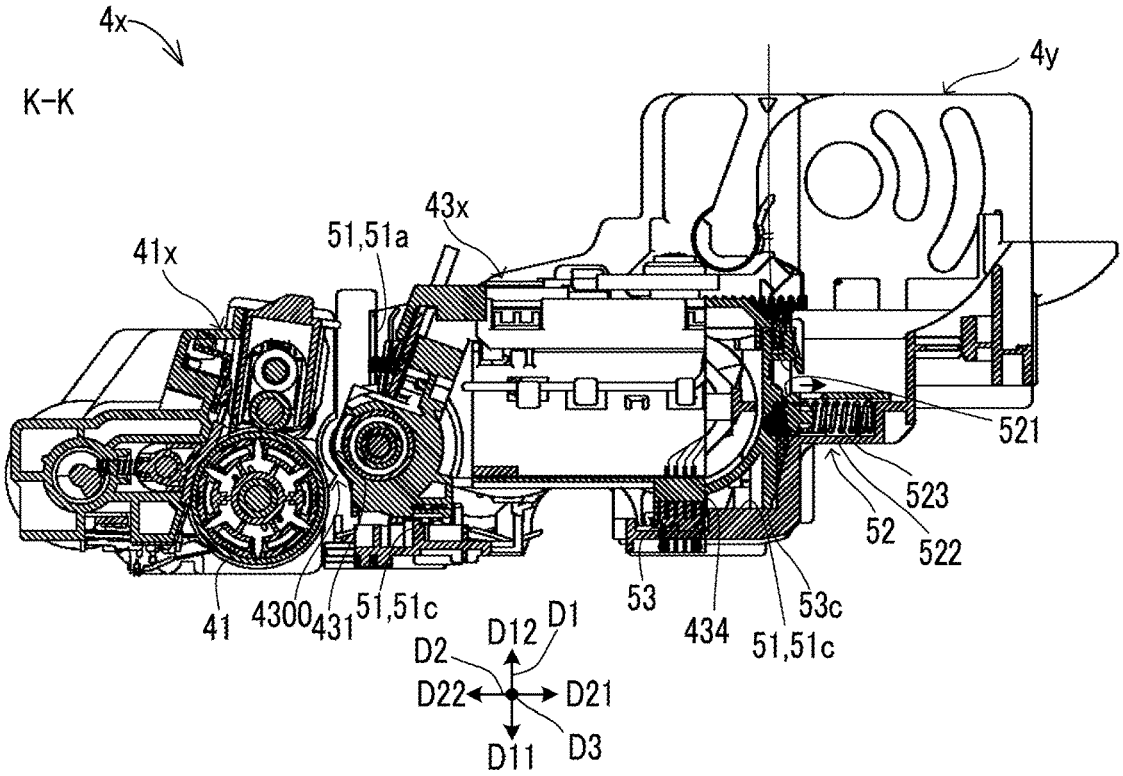
FIG. 8 is a first cross-section diagram of the image creating portion in the middle of attachment of the developing unit in the image forming apparatus according to the embodiment.
Figure 9:
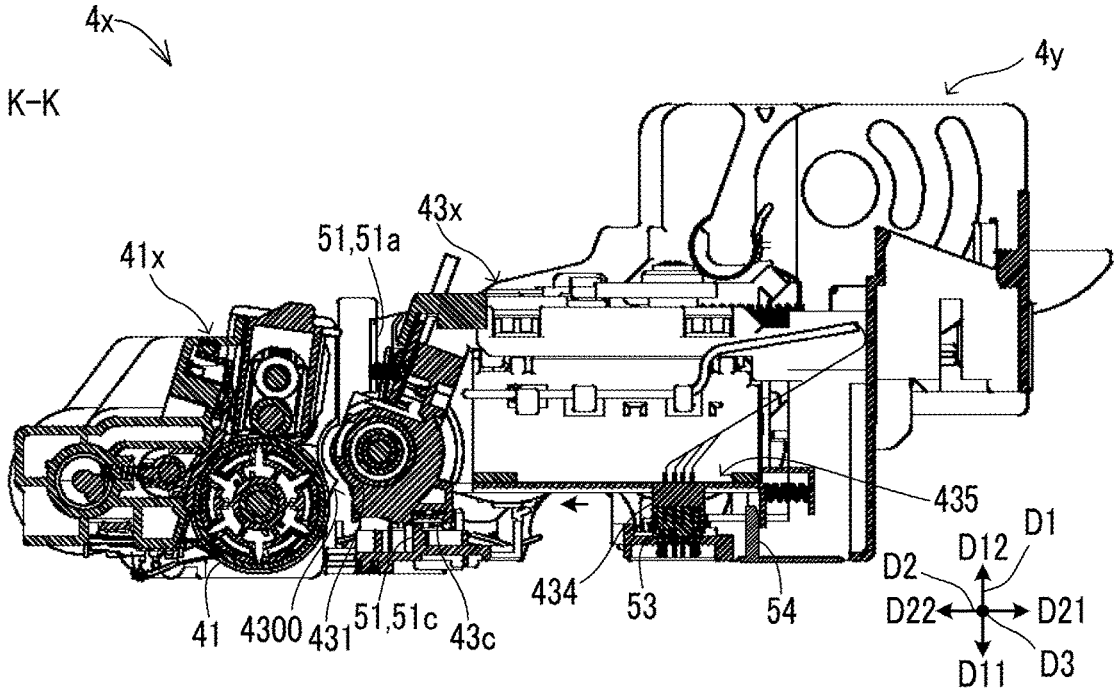
FIG. 9 is a second cross-section diagram of the image creating portion in the middle of attachment of the developing unit in the image forming apparatus according to the embodiment.
Figure 10:
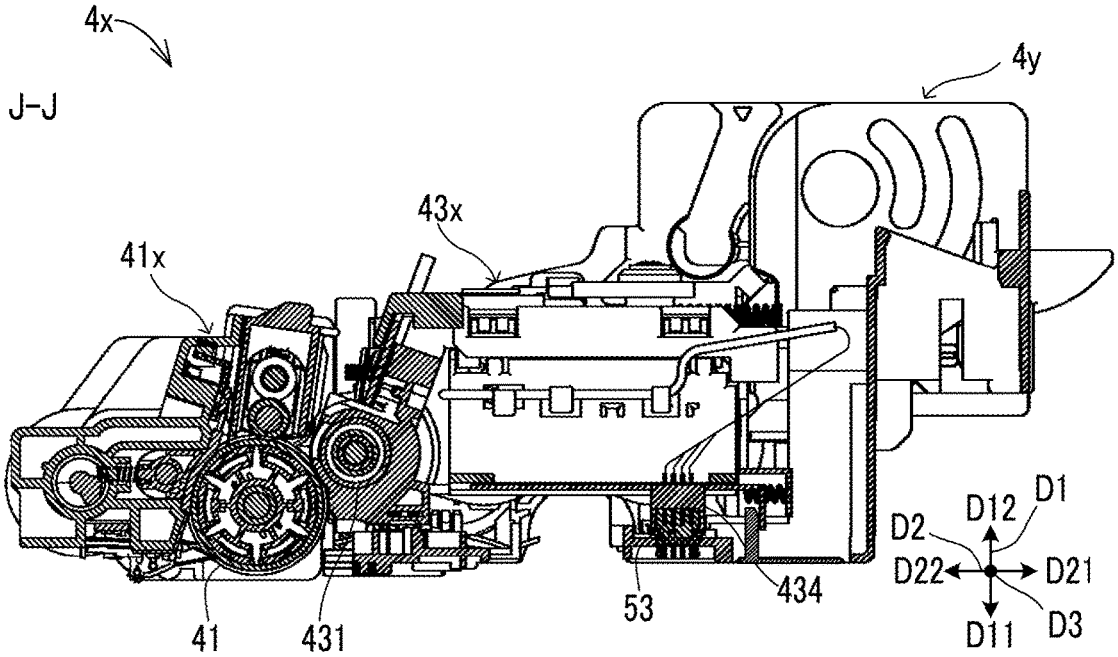
FIG. 10 is a second cross-section diagram of the image creating portion of the image forming apparatus according to the embodiment.

FIG. 8 and FIG. 9 show a state where the developing unit 43$x$ is located at the connection position, and FIG. 5 and FIG. 10 show a state where the developing unit 43$x$ is located at the attachment position.

As shown in FIG. 8 and FIG. 9, when the developing unit 43$x$ is located at the connection position, the developing roller 431 is separated from the photoconductor 41 by a predetermined gap 4300. On the other hand, as shown in FIG. 5 and FIG. 10, when the developing unit 43$x$ is located at the attachment position, the developing roller 431 is in contact with the photoconductor 41 or separated from the photoconductor 41 by an extremely small gap smaller than the gap 4300.

The connector support mechanism 435 allows the developing unit 43$x$ to move between the connection position and the attachment position in a state where the unit connector 434 is connected to the main body connector 53.

Accordingly, when the developing unit 43$x$ is attached to the image creation base portion 4$y$, first, the developing unit 43$x$ is guided by the first unit guide portions 51$a$ and 51$b$ to the connection position, thereby the unit connector 434 is connected to the main body connector 53 in a state where the developing roller 431 is separated from the photoconductor 41 by the gap 4300 that is relatively large (see FIG. 4, FIG. 8, FIG. 9).

The developing unit 43$x$ is further guided by the second unit guide portion 51$c$ from the connection position to the attachment position. This completes the attachment of the developing unit 43$x$. In addition, when the developing unit 43$x$ is removed from the image creation base portion 4$y$, an operation reverse to that for the attachment thereof is performed.

With the above-described configuration, a worker such as a user can easily attach or detach the developing unit 43$x$ to/from the main body portion 100 without performing a work of connecting the unit connector 434 to the main body connector 53.

In addition, in the stage where the developing unit 43$x$ has been pressed to the connection position to connect the connector, the developing roller 431 is separated from the photoconductor 41 by the gap 4300.

Furthermore, the connector connection is completed before the developing unit 43$x$ moves from the connection position to the attachment position. As a result, the developing unit 43$x$ does not need to be pressed strongly toward the photoconductor 41.

Accordingly, when the developing unit 43$x$ is attached or detached, the photoconductor 41 is difficult to be damaged due to contact between the developing roller 431 and the photoconductor 41.

The image forming apparatus 10 further includes a biasing mechanism 52 (see FIG. 4, FIG. 5, FIG. 8). The biasing mechanism 52 includes a contact member 521, a slide support portion 522, and a spring 523.

The contact member 521 is configured to come in contact with the developing unit 43$x$ guided by the unit guide portion 51. The slide support portion 522 supports the rotation support portion 521 such that the rotation support portion 521 can be displaced between an interference position and a retracted position, wherein the interference position is within a movement path of the developing unit 43$x$ and the retracted position is located outside the movement path of the developing unit 43$x$.

The spring 523 elastically biases the contact member 521 toward the interference position. The slide support portion 522 and the spring 523 are an example of a contact member support mechanism.

The contact member 521 receives a force from the developing unit 43$x$ when the developing unit 43$x$ approaches the connection position along the first direction D1, and thereby is displaced from the interference position to the retracted position against the elastic biasing force of the spring 523 (see FIG. 8, FIG. 9). When the developing unit 43$x$ reaches the connection position, the developing unit 43$x$ is biased by the spring 523 via the contact member 521 toward the attachment position.

Due to the action of the biasing mechanism 52, the movement of the developing unit 43$x$ from the connection position to the attachment position is automated. It is noted that when the developing unit 43$x$ is removed, the worker moves the developing unit 43$x$ from the attachment position to the connection position against the biasing force of the spring 523.

APPLICATION EXAMPLE

Another attachment unit such as a drum unit 41$x$ may be attached to the main body portion 100 in a detachable manner. In this case, the structure for the attachment/detachment of the developing unit 43$x$ may be adopted as the structure for the attachment/detachment of the other attachment unit.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

an attachment unit attached to a main body portion in a detachable manner, the main body portion including a print device configured to form an image on a sheet, the attachment unit including a facing part disposed to face a target part that constitutes a part of the print device in the main body portion, the facing part constituting another part of the print device;

a first connector provided in the main body portion;

a second connector configured to be connected to the first connector by being made to approach the first connector along a first direction;

a connector support mechanism provided in the attachment unit, the connector support mechanism supporting the second connector so that the second connector can be displaced along a second direction that intersects the first direction, and temporarily holding the second connector at a predetermined reference position in the second direction; and a unit guide portion provided in the main body portion and configured to guide the attachment unit between a connection position and a position that is more separated from the main body portion than the connection position is, along the first direction in a slidably moving manner, the connection position being a position at which the attachment unit is located when the second connector held at the reference position is connected to the first connector, the unit guide portion further guiding the attachment unit between the connection position and an attachment position that is closer to the target part than the connection position is, along the second direction in the slidably moving manner, wherein the connector support mechanism includes an elastic member configured to temporarily hold the second connector at the reference position by elastically biasing the second connector toward the reference position, and the connector support mechanism allows the attachment unit to move between the connection position and the attachment position in a state where the second connector is connected to the first connector.

2. The image forming apparatus according to claim 1, wherein the target part includes an image carrier, wherein an electrostatic latent image is formed on a surface of the image carrier, and the facing part includes a developing roller configured to supply toner to the surface of the image carrier.

3. An image forming apparatus comprising:

an attachment unit attached to a main body portion in a detachable manner, the main body portion including a print device configured to form an image on a sheet, the attachment unit including a facing part disposed to face a target part that constitutes a part of the print device in the main body portion, the facing part constituting another part of the print device;

a first connector provided in the main body portion;

a second connector configured to be connected to the first connector by being made to approach the first connector along a first direction;

a connector support mechanism provided in the attachment unit, the connector support mechanism supporting the second connector so that the second connector can be displaced along a second direction that intersects the first direction, and temporarily holding the second connector at a predetermined reference position in the second direction;

a unit guide portion provided in the main body portion and configured to guide the attachment unit between a connection position and a position that is more separated from the main body portion than the connection position is, along the first direction in a slidably moving manner, the connection position being a position at which the attachment unit is located when the second connector held at the reference position is connected to the first connector, the unit guide portion further guiding the attachment unit between the connection position and an attachment position that is closer to the target part than the connection position is, along the second direction in the slidably moving manner;

a contact member configured to come in contact with the attachment unit guided by the unit guide portion; and a contact member support mechanism configured to support the contact member such that the contact member can be displaced between an interference position and a retracted position and configured to elastically bias the contact member toward the interference position, the interference position being within a movement path of the attachment unit, the retracted position being located outside the movement path of the attachment unit, wherein the contact member receives a force from the attachment unit when the attachment unit approaches the connection position along the first direction, and thereby is displaced from the interference position to the retracted position against an elastic biasing force of the contact member support mechanism, and when the attachment unit reaches the connection position, the attachment unit is biased by the contact member support mechanism via the contact member toward the attachment position, and the connector support mechanism allows the attachment unit to move between the connection position and the attachment position in a state where the second connector is connected to the first connector.

4. The image forming apparatus according to claim 3, wherein the target part includes an image carrier, wherein an electrostatic latent image is formed on a surface of the image carrier, and the facing part includes a developing roller configured to supply toner to the surface of the image carrier.

* * * * *